US005971505A

United States Patent [19]

Zamora

[11] Patent Number: 5,971,505

[45] Date of Patent: Oct. 26, 1999

[54] SNAP-IN GRILLE FOR AN AIR CONDITIONER HOUSING

[75] Inventor: Victoriano Zamora, Nuevo Leon, Mexico

[73] Assignee: Carrier Corporation, Syracuse, N.Y.

[21] Appl. No.: 09/140,463

[22] Filed: Aug. 26, 1998

[51] Int. Cl.[6] ..... A47B 81/00

[52] U.S. Cl. ..... 312/213; 312/236; 62/298

[58] Field of Search ..... 312/100, 101, 312/213, 236; 62/262, 263, 298; 124/66

[56] References Cited

U.S. PATENT DOCUMENTS

| | | | |
|---|---|---|---|
| 4,261,418 | 4/1981 | Helt et al. | 312/236 |
| 5,184,475 | 2/1993 | Matsumi | 312/101 |
| 5,294,195 | 3/1994 | Amr et al. | 312/236 |
| 5,660,054 | 8/1997 | Rice | 312/236 |
| 5,775,119 | 7/1998 | Yamada et al. | 312/100 |

*Primary Examiner*—Peter M. Cuomo
*Assistant Examiner*—Gerald A. Anderson

[57] ABSTRACT

An air conditioning unit is provided which includes an outdoor section, which has a condenser coil mounted therein and an outer protective housing partially enclosing the outdoor section. The housing has a substantially rectangular opening therein in overlying relation with the condenser coil. The opening is defined by at least two spaced parallel coplanar wall sections, each of which has a predetermined width. A flexible protective grille, which is configured to substantially cover the rectangular opening, has two edges thereof which are spaced from one another by a distance substantially equal to the spacing of the wall sections. Each of the edges have integrally formed therewith two or more narrow, rigid, spaced apart extensions, which project perpendicularly therefrom. Each of the narrow extensions has a length less than the predetermined width of the wall sections. Each of the wall sections is provided with conformations, which are formed at locations corresponding to the location of each of the narrow extensions. The conformations are configured to mechanically receive and retain the narrow extensions, which are formed on a first edge of the grille without flexing of the grille. The narrow extensions on the second edge of the grille are thereafter mechanically received and retained with their respective retaining conformations upon flexing of the grille. Following assembly of the extensions on the second edge of the grille, the grille returns to its undeformed condition and is then thereby positively mounted in the opening.

5 Claims, 2 Drawing Sheets

SNAP-IN GRILLE FOR AN AIR CONDITIONER HOUSING

BACKGROUND OF THE INVENTION

The present invention is directed to air conditioners and, more particularly, to a protective grille for the condenser coil of an air conditioner.

Air conditioning units such as so-called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from the room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

Because the condenser coil includes a multitude of fragile heat exchange fins thereon, protective louvers or a grille of some sort is commonly provided to overlie the back of the condenser coil to protect the fins from damage. It is common practice in larger air conditioning units for the back of the housing of the unit to be substantially open and for the protective grille to be formed from a plurality of perpendicularly extending wire segments, which are welded to wall sections forming the perimeter of the open back of the housing. Such grilles must be welded to the housing prior to applying the finish paint coat to the housing.

It is considered desirable to be able to fabricate the housing of an air conditioning unit from a pre-painted sheet metal material. It is further considered desirable to be able to install a protective grille to a housing formed from a pre-painted metal material without the necessity of welding the grille to the housing. Such welding would require removal of paint from the housing in the area in which the grille would be welded thereto and further would require touch-up painting as the heat of the welding would damage the preapplied paint.

SUMMARY OF THE INVENTION

An air conditioning unit is provided which includes an outdoor section, which has a condenser coil mounted therein and an outer protective housing partially enclosing the outdoor section. The housing has a substantially rectangular opening therein in overlying relation with the condenser coil. The opening is defined by at least two spaced parallel coplanar wall sections, each of which has a predetermined width. A flexible protective grille, which is configured to substantially cover the rectangular opening, has two edges thereof which are spaced from one another by a distance substantially equal to the spacing of the wall sections. Each of the edges have integrally formed therewith two or more narrow, rigid, spaced apart extensions, which project perpendicularly therefrom. Each of the narrow extensions has a length less than the predetermined width of the wall sections. Each of the wall sections is provided with conformations, which are formed at locations corresponding to the location of each of the narrow extensions. The conformations are configured to mechanically receive and retain the narrow extensions, which are formed on a first edge of the grille without flexing of the grille. The narrow extensions on the second edge of the grille are thereafter mechanically received and retained with their respective retaining conformations upon flexing of the grille. Following assembly of the extensions on the second edge of the grille, the grille returns to its undeformed condition and is then thereby positively mounted in the opening.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
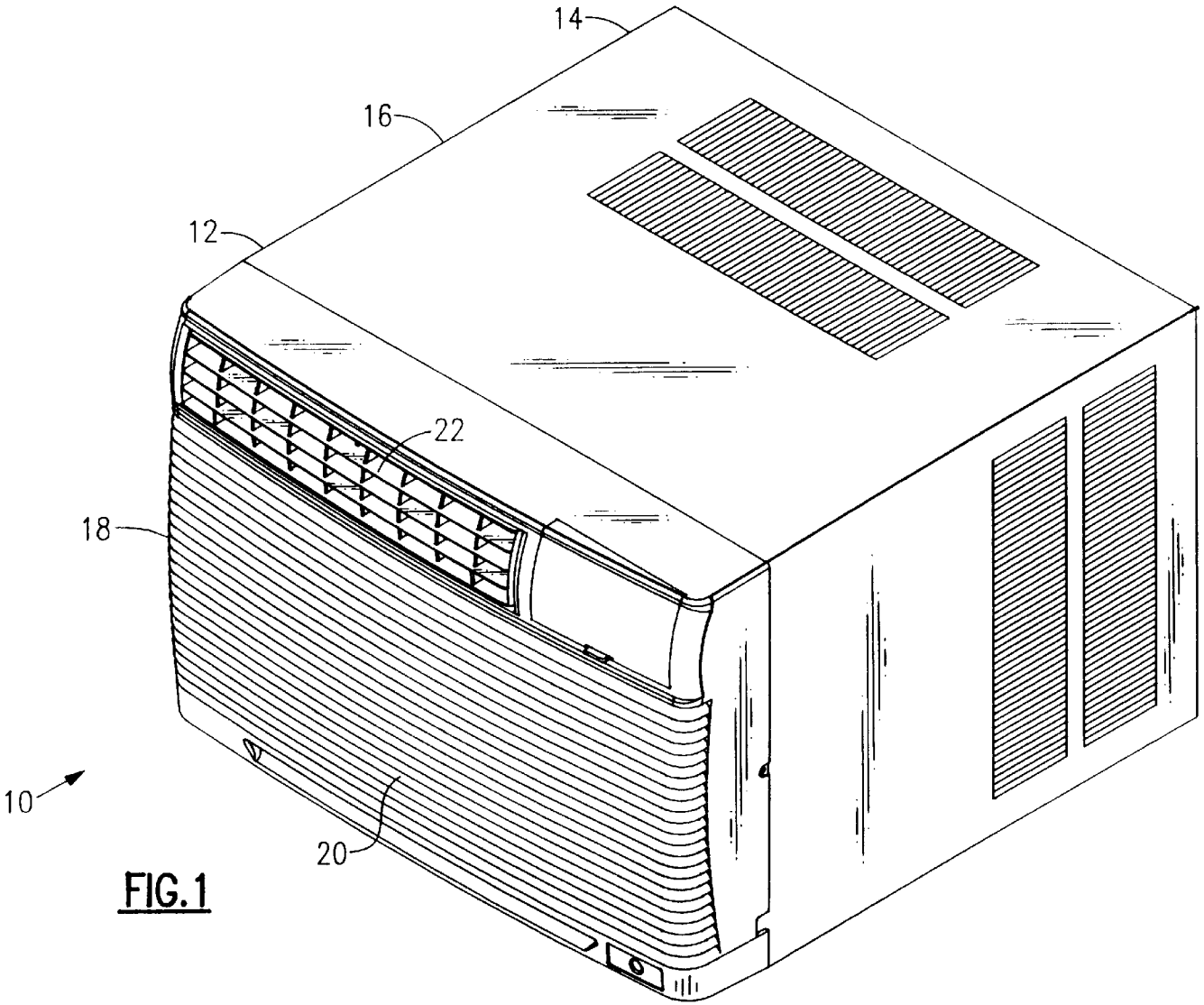
FIG. 1 a front perspective view of a room air conditioner, which embodies the features of this invention.

FIG. 1 illustrates an air conditioner unit 10 which includes generally an indoor section 12 and an outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional.

The indoor section 12 includes an indoor grille section 18, which includes inlet louvers 20 and an air discharge assembly 22. During operation of the air conditioner, air from the spaced to be conditioned by the unit is drawn by action of an evaporator fan (not shown) through the inlet louvers 20 and is directed through an evaporator coil (not shown) where the air is cooled. The cooled air is then directed back into the room to be cooled through the air discharge assembly 22.

Figure 2:
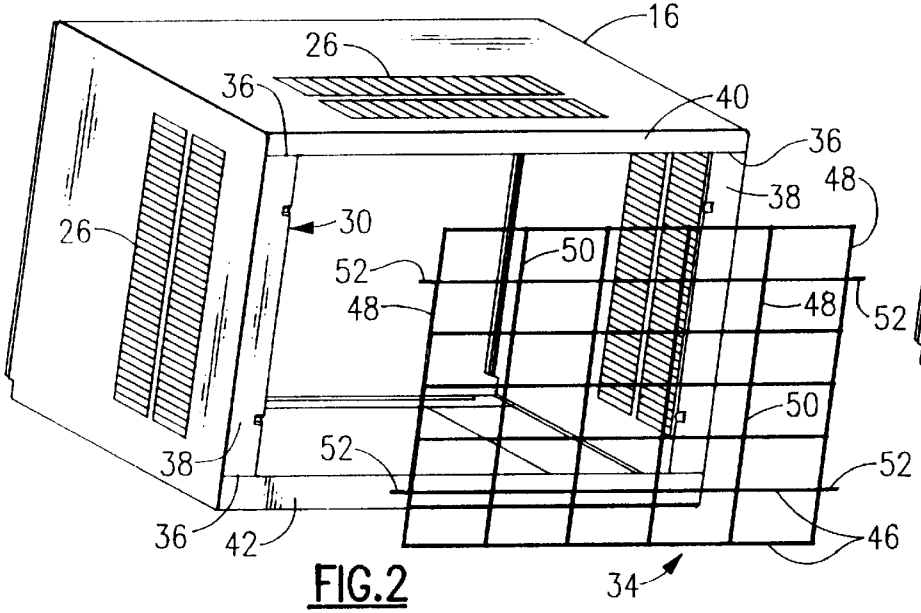
FIG. 2 is a rear perspective view of the housing of a room air conditioner of the type illustrated in FIG. 1 with the rear grille uninstalled.

Looking now at FIGS. 2 and 3, the air conditioning unit 10 also includes, as is conventional, an outdoor refrigerant to air heat exchanger 24, or coil, hereinafter "condenser coil 24". The condenser coil 24 is fluidly interconnected with a compressor (not shown) and the unit evaporator in a conventional manner to provide cooling to the room in which the unit is installed. In operation, ambient air enters the housing 16 through a plurality of louvered air inlets 26 located in the tops and sides of the housing 16. Ambient air is drawn through the inlets 26 by operation of an outdoor fan (not shown) and is directed through the condenser coil 24 before exiting from the backside 28 of the condenser coil and through a large rectangular opening 30 in the housing 16, which is in overlying relationship with the backside 28 of the condenser coil 24.

Figure 3:
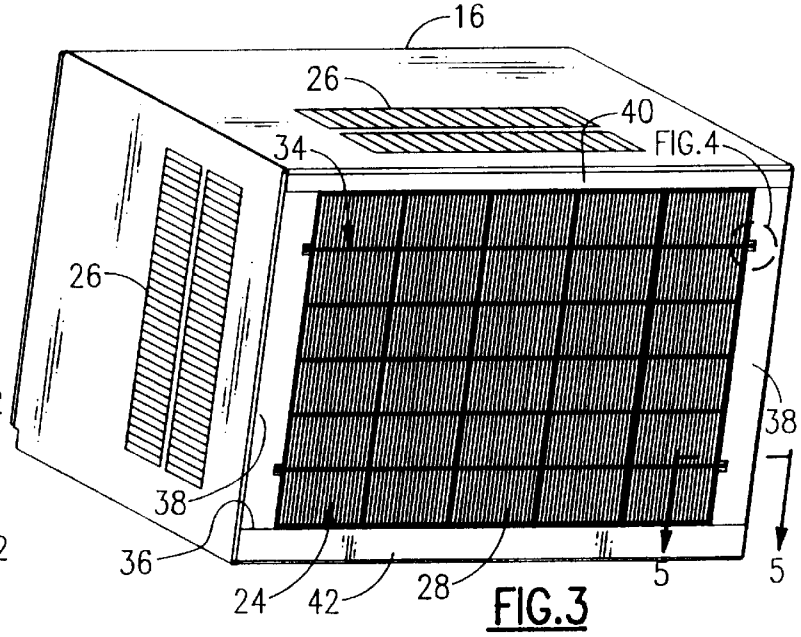
FIG. 3 is a rear view of the air conditioner of FIG. 1 with the rear grille installed.
Figure 5:
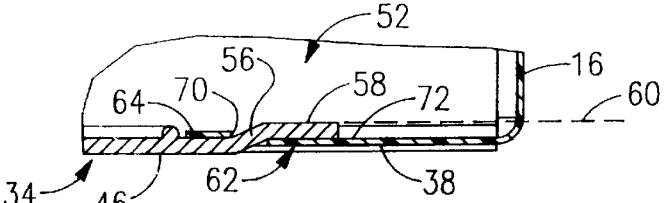
FIG. 5 is-a sectional view taken along the line 5—5 of FIG. 3.

As is best seen in FIGS. 3 and 5, the backside 28 of the condenser coil 24 is defined by a plurality of vertically extending heat exchange fins 32, which serve to facilitate heat transfer from the hot refrigerant running through the coil 28 to the air flowing therethrough. The fins 32 are extremely fragile and are protected by an overlying rectangularly shaped protective grille 34. As will now be described in detail, the grille 34 is attached to the housing 16 without requiring any welding or other supplementary attachment hardware.

In the preferred embodiment, the housing 16 is formed from pre-painted sheet steel material, which is mechanically interconnected at various overlapping joints 36, also without requiring any welding or additional mechanical fastening means. The large opening 30 overlying the condenser coil 24 is defined by a pair of vertically extending, spaced, parallel coplanar wall sections 38 on the left and right-hand sides thereof, as viewed in FIGS. 2 and 3. The top and bottom of the opening 30 is defined by a pair of horizontally extending coplanar wall sections 40 and 42, respectively.

A protective grille 34 is formed from a plurality of horizontally extending spaced apart length of wire 46, which are in overlying relationship with a plurality of vertically extending spaced lengths of wire 48. The horizontal 46 and vertical 48 wire sections are attached to one another as by welding at each of the intersections 50 therebetween. As so interconnected, the horizontal and vertical wire sections define an outer perimeter which is only slightly smaller in dimension than the opening 30.

Figure 4:
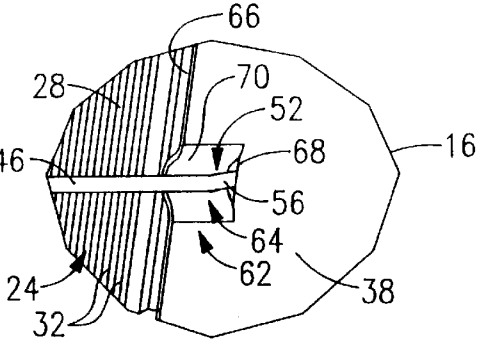
FIG. 4 is an enlarged view of the section identified as FIG. 4 in FIG. 3.

Two of the horizontally extending wire lengths 46 are provided with lateral extensions 52, which extend from the outer perimeter of the grille by a distance less than the width of the side wall sections 38. As best seen in FIGS. 4 and 5, each of the extension 52 extends for a portion of its length 54 in a plane coplanar with the grille 34 and then undergoes a "dog leg" bend 56 and terminates in an outer section 58, which lies in a plane 60 spaced rearwardly from the plane of the grille 34.

Again, as best shown in FIGS. 4 and 5, each of the side wall sections 38 is provided with a conformations 62 adapted to receive each of the extensions 52 of the grille therein. The conformations 62 each include a rearwardly displaced arcuate section 64 adjacent to the inner edges 66 of the side wall sections 38. The arcuate sections 64 are formed by punching a vertically extending cut 68 in the side wall section 38 and partially deforming and displacing the material adjacent to the cut rearwardly.

The arcuate section 64 defines a support surface 70 which, together with the back surface 72 of the adjacent section of the side wall section 38, serve to receive and support the section 54 of the extension 52 and the outer section 58, respectively. As so positioned, the bend 56 provides the transition between the two support surfaces and thus allows the extensions 52 to be received in the conformations 62 with the grille 44 supported in substantially coplanar relationship with the opening 30, as illustrated in FIGS. 3, 4 and 5.

It should be appreciated that the wire sections forming the grille 44 are flexible and, accordingly, mounting of the grille into the opening is carried out by inserting the extensions 52 on one side of the grille into their mating conformations 62, and then, flexing the grille to thereby insert the extensions 52 on the other side of the grille into their mating conformations 62.

What is claimed is:

1. An air conditioner of the type having an outdoor section, which has a condenser coil mounted therein and an outer protective housing partially enclosing the outdoor section, wherein the improvement comprises:

said housing having a substantially rectangular opening therein in overlying relation with said condenser coil, said opening being defined by at least two spaced, parallel, coplanar wall sections, each having a predetermined width;

a flexible protective grille configured to substantially cover said rectangular opening, said grille having two edges thereof spaced from one another by a distance substantially equal to said spacing of said wall sections, each of said edges having integrally formed therewith two or more narrow, rigid, spaced apart extensions, projecting perpendicularly therefrom, each of said narrow extensions having a length less than said predetermined width of said wall sections;

each of said wall sections having conformations formed therein at locations corresponding to the location of each of said narrow extensions, said conformations being configured to mechanically receive and retain said narrow extensions on a first edge of said grille therein without flexing of said grille, and to thereafter mechanically receive and retain said narrow extensions on the second edge of said grille upon flexing of said grille to a deformed condition, said grille being configured to return to an undeformed condition upon engagement of said extensions of said second edge with their respective receiving and retaining conformations.

2. The apparatus of claim 1 wherein said flexible protective grille comprises a plurality of vertically extending spaced apart equal lengths of wire, and a plurality of horizontally extending spaced lengths of wire overlying said vertical lengths and contacting said vertical lengths at a plurality of locations, said vertical extending wires and said horizontally extending wires being attached to one another at each of said intersections;

at least a pair of said horizontally extending wires extending beyond the extreme left and right hand vertical wire section to thereby define said narrow extensions.

3. The apparatus of claim 2 wherein said conformations in said wall section comprise downwardly displaced arcuate sections adjacent inner edges of said walls, said conformations having a length less than that of said narrow extensions and defining an opening communicating with the underside of said wall sections in which they are formed;

whereby said narrow extensions will be received in said downwardly displaced arcuate sections and pass through said openings to contact the underside of said wall sections when said flexible grille is installed to said housing.

4. The apparatus of claim 3 wherein each of said narrow extensions is bent at substantially the midpoint of its length thereof to thereby define an outer section of said extension lying in a plane displaced from said grille whereby when said extensions are assembled to said conformations, the end of said extension lying in said displaced plane lies under the plane defined by said coplanar wall sections and said grille is substantially coplanar with said planar wall sections.

5. The apparatus of claim 4 wherein said wires forming said grille are protected by an outer flexible plastic coating.

* * * * *